US012590788B2

(12) United States Patent
Choi et al.

(10) Patent No.: US 12,590,788 B2
(45) Date of Patent: Mar. 31, 2026

(54) DEVICE METHOD OPERATING ELECTRONIC DETONATOR HAVING RESPONSE RELAY FUNCTION

(71) Applicant: HANWHA CORPORATION, Seoul (KR)

(72) Inventors: Jeong Ho Choi, Cheongju-si (KR); Se Ho Kim, Cheongju-si (KR)

(73) Assignee: HANWHA CORPORATION, Seoul (KR)

( * ) Notice: Subject to any disclaimer, the term of this patent is extended or adjusted under 35 U.S.C. 154(b) by 470 days.

(21) Appl. No.: 18/008,721

(22) PCT Filed: Oct. 7, 2022

(86) PCT No.: PCT/KR2022/015147
§ 371 (c)(1),
(2) Date: Dec. 7, 2022

(87) PCT Pub. No.: WO2023/128159
PCT Pub. Date: Jul. 6, 2023

(65) Prior Publication Data

US 2024/0230297 A1 Jul. 11, 2024

(30) Foreign Application Priority Data

Dec. 29, 2021 (KR) ..... 10-2021-0190499

(51) Int. Cl.
*F42C 11/06* (2006.01)
*F42C 19/08* (2006.01)
*F42D 1/045* (2006.01)

(52) U.S. Cl.
CPC ..... *F42C 11/06* (2013.01); *F42C 19/08* (2013.01); *F42D 1/045* (2013.01)

(58) Field of Classification Search
USPC ..... 102/311
See application file for complete search history.

(56) References Cited

U.S. PATENT DOCUMENTS 11,441,883 B2 * 9/2022 Maurissens ..... F42D 1/02

FOREIGN PATENT DOCUMENTS

AU 2019284135 A1 7/2020
AU 2019284158 A1 7/2020

* cited by examiner

*Primary Examiner* — Reginald S Tillman, Jr.
(74) *Attorney, Agent, or Firm* — WHDA, LLP

(57) ABSTRACT

A device and a method thereof for operating an electronic detonator having a response relay function are proposed. The device includes a command signal reception unit configured to receive a command signal transmitted from a blasting control system, a response signal transmission unit configured to transmit a response signal responsive to the received command signal to the blasting control system, and a response signal delivery unit configured to transmit the corresponding response signal to the blasting control system when a response signal of another electronic detonator adjacent within a preset distance is recognized.

4 Claims, 2 Drawing Sheets

DEVICE METHOD OPERATING ELECTRONIC DETONATOR HAVING RESPONSE RELAY FUNCTION

TECHNICAL FIELD

The present disclosure relates to a device and a method thereof for operating an electronic detonator having a response relay function and, more particularly, to a device and a method thereof for operating an electronic detonator having a response relay function, wherein when a received command signal of a blasting control system is the same as a previously received command signal, presence or absence of a response signal of another electronic detonator adjacent within a preset distance is recognized and the same response signal as the response signal to be transmitted from another electronic detonator is transmitted instead to the blasting control system in accordance with a cycle of the recognized response signal of the corresponding another electronic detonator.

BACKGROUND ART

In general, an explosive is used for construction work such as blasting of bedrock for tunnel construction and blasting of an abandoned building. That is, by dividing a blasting object by section, a plurality of holes into which the explosive is inserted is drilled. The explosive is inserted into each of the drilled holes and connected to a blasting system. Detonation of the blasting object is conducted by detonating the explosive through manipulating the blasting system.

The blasting system is configured to include: a detonator, which is an initial explosive for detonating an explosive; and a blasting device configured to transmit, to the detonator, power and a command, which are required for operation of the detonator. In this case, an electronic detonator is mainly used as the detonator of the blasting system. The electronic detonator is installed on the side of the explosive, and a plurality of electronic detonators is connected to one blasting device.

The electronic detonator is provided with a structure in which when a command is transmitted from the blasting device, the plurality of electronic detonators connected to the corresponding blasting device operates simultaneously to detonate each explosive at the same time, and a structure in which a plurality of electronic detonators is set at different delay times, so that the plurality of electronic detonators is sequentially operated, thereby sequentially detonating each explosive.

In a connection system for the electronic detonators as described above, weakening of a detonator response signal may occur due to a number of causes. Consequently, a response signal according to a command of each corresponding electronic detonator is not transmitted to the blasting system, thereby causing the blasting system to perform re-communication. However, since signal quality is not improved unless a particular cause of the signal weakened due to a line condition is removed, there is a problem in that a probability of successful communication is low in multiple attempts for communication in the corresponding condition.

In this regard, Korean Patent Application Publication No. 2020-0082156 discloses "DETONATOR DEVICE, OPERATING METHOD OF DETONATOR DEVICE AND COMMUNICATION SYSTEM".

DISCLOSURE

Technical Problem

The present disclosure is devised to solve the above-described problem, and an objective of the present disclosure is to provide a device and a method thereof for operating an electronic detonator having an response relay function, wherein when a received command signal of a blasting control system is the same as a previously received command signal, presence or absence of a response signal of another electronic detonator adjacent within a preset distance is recognized and the same response signal as the response signal to be transmitted from another electronic detonator is transmitted instead to the blasting control system in accordance with a cycle of the recognized response signal of the corresponding another electronic detonator.

Technical Solution

According to the present disclosure for achieving the above objective, there is provided a device for operating an electronic detonator having a response relay function, the device including: a command signal reception unit configured to receive a command signal transmitted from a blasting control system; a response signal transmission unit configured to transmit a response signal responsive to the received command signal to the blasting control system; and a response signal delivery unit configured to transmit the corresponding response signal to the blasting control system when a response signal of another electronic detonator adjacent within a preset distance is recognized.

In addition, the device may further include an adjacent response signal recognition unit configured to recognize presence or absence of the response signal of the corresponding another electronic detonator adjacent within the preset distance when the blasting control system's command signal received by the command signal reception unit is the same as a previously received command signal.

In addition, the response signal of the corresponding another electronic detonator adjacent within the preset distance and recognized by the response signal delivery unit may be a response signal that is not transmitted to the blasting control system.

In addition, the response signal delivery unit may transmit instead the same response signal as the response signal to be transmitted from the corresponding another electronic detonator to the blasting control system in accordance with a cycle of the response signal of the corresponding another electronic detonator adjacent within the preset distance.

According to the present disclosure for achieving the above objective, there is provided a method for operating an electronic detonator having a response relay function, the method including: receiving, by a command signal reception unit, a command signal transmitted from a blasting control system; transmitting, by a response signal transmission unit, a response signal responsive to the received command signal to the blasting control system; and transmitting, by a response signal delivery unit, the corresponding response signal to the blasting control system when a response signal of another electronic detonator adjacent within a preset distance is recognized.

In addition, the method may further include, before the transmitting of the corresponding response signal to the blasting control system when the response signal of the corresponding another electronic detonator adjacent within the preset distance is recognized, recognizing presence or absence of the response signal of the corresponding another electronic detonator adjacent within the preset distance when the blasting control system's command signal received by the command signal reception unit is the same as a previously received command signal.

In addition, in the transmitting of the corresponding response signal to the blasting control system when the response signal of the corresponding another electronic detonator adjacent within the preset distance is recognized, the recognized response signal of the corresponding another electronic detonator adjacent within the preset distance may be a response signal that is not transmitted to the blasting control system.

In addition, in the transmitting of the corresponding response signal to the blasting control system when the response signal of the corresponding another electronic detonator adjacent within the preset distance is recognized, the same response signal as the response signal to be transmitted from the corresponding another electronic detonator may be transmitted instead to the blasting control system in accordance with a cycle of the response signal of the corresponding another electronic detonator adjacent within the preset distance.

Advantageous Effects

The present disclosure relates to the device and the method thereof for operating the electronic detonator having the response relay function, wherein when the received command signal of the blasting control system is the same as the previously received command signal, the presence or absence of the response signal of another electronic detonator adjacent within the preset distance is recognized and the same response signal as the response signal to be transmitted from another electronic detonator is transmitted instead to the blasting control system in accordance with the cycle of the recognized response signal of the corresponding another electronic detonator, whereby there is an effect that when the blast control system attempts to re-communicate in a condition where the response signal of a particular electronic detonator is attenuated on a particular line, the response of the corresponding particular electronic detonator may be easily received.

In this way, the embodiment of the present disclosure may increase the reliability of the electronic detonator by reducing the possibility of failure due to poor communication in the blasting or control of the electronic detonator.

BEST MODE

Figure 1:
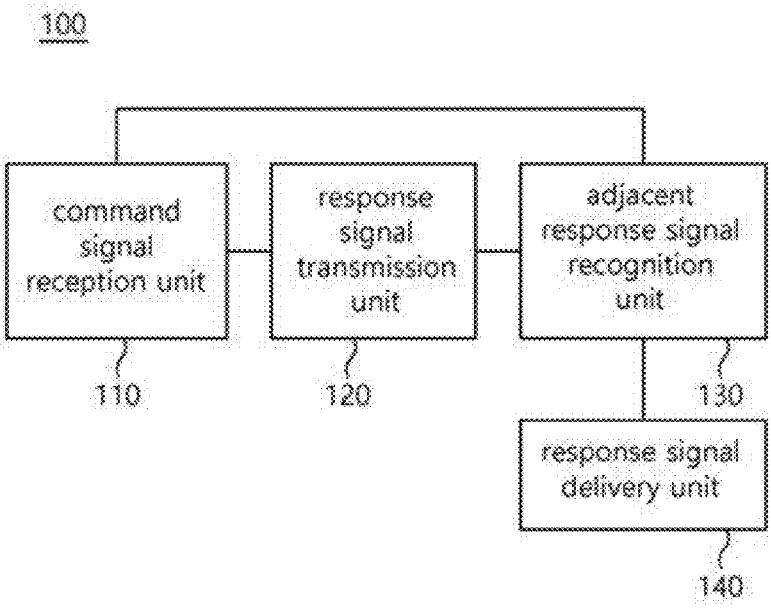
FIG. 1 is a view illustrating a configuration of a device for operating an electronic detonator having a response relay function according to the present disclosure.

In the present disclosure, various modifications may be made and various exemplary embodiments may be provided, and specific exemplary embodiments will be illustrated in the drawings and described in detail.

However, this is not intended to limit the present disclosure to a particular disclosed form. On the contrary, the present disclosure is to be understood to include all various alternatives, equivalents, and substitutes that may be included within the idea and technical scope of the present disclosure. While describing each drawing, similar reference numerals have been used for similar components.

When a component is described as being "connected", "coupled", or "linked" to another component, that component may be directly connected, coupled, or linked to that other component. However, it should be understood that yet another component between each of the components may be present. In contrast, it should be understood that when a component is referred to as being "directly coupled" or "directly connected" to another component, there are no intervening components present.

The terminology used herein is for the purpose of describing particular exemplary embodiments only and is not intended to be limiting. As used herein, the singular forms are intended to include the plural forms as well, unless the context clearly indicates otherwise. In addition, it will be further understood that the terms "comprise", "include", "have", etc. when used in the present application, specify the presence or absence of stated features, integers, steps, operations, elements, components, and/or combinations of them but do not preclude the possibility of the presence or addition of one or more other features, integers, steps, operations, elements, components, and/or combinations thereof.

Hereinafter, preferred exemplary embodiments of the present disclosure will be described in more detail with reference to the accompanying drawings. Hereinafter, the same reference numerals are used for the same components in the drawings, and duplicate descriptions for the same components are omitted.

FIG. 1 is a view illustrating a configuration of a device for operating an electronic detonator having a response relay function according to the present disclosure.

Describing with reference to FIG. 1, the device 100 for operating the electronic detonator having the response relay function according to the present disclosure largely includes a command signal reception unit 110, a response signal transmission unit 120, an adjacent response signal recognition unit 130, and a response signal delivery unit 140.

The command signal reception unit 110 receives a command signal transmitted from a blasting control system.

The response signal transmission unit 120 transmits a response signal responsive to the received command signal to the blasting control system.

The adjacent response signal recognition unit 130 recognizes presence or absence of a response signal of another electronic detonator adjacent within a preset distance when the blasting control system's command signal received through the command signal reception unit 110 is the same as the previously received command signal. Here, the preset distance is changed depending on line conditions, is set accordingly.

The response signal delivery unit 140 transmits the corresponding response signal to the blasting control system when the response signal of another electronic detonator adjacent within the preset distance is recognized.

In this case, the response signal of another electronic detonator, which is adjacent within the preset distance and recognized by the response signal delivery unit 140, is the response signal that is not transmitted to the blasting control system.

In more detail, a condition in which the response signal of the electronic detonator is attenuated may occur due to a high background current, a high communication line resistance, or the like. In such a condition, due to the response signal of the electronic detonator, that is, the characteristics of electric current communication, the electronic detonator consumes energy close to the limit of energy that may be consumed in the electric current communication on a line. In this case, the corresponding energy consumption may be received in a form of a supply voltage reduction in the electronic detonator adjacent to corresponding electronic detonator (i.e., similar to a voltage mode communication method transmitted by the blast control system), and thus the response of the adjacent electronic detonator may be detected.

The response signal delivery unit 140 may transmit instead the same response signal as the response signal to be transmitted from another electronic detonator to the blasting control system in accordance with a cycle of the response signal of the corresponding another electronic detonator adjacent within the preset distance.

As such, when the present electronic detonator receives the same command as the previously received command in a recommunication attempt condition of the blasting control system with respect to another electronic detonator adjacent within the preset distance, the present electronic detonator participates in the response to the blast control system with the same response signal and the same timing as the timing responded by another electronic detonator adjacent within the preset distance.

In addition, the embodiment of the present disclosure causes a signal to be amplified due to a parallel signal. In addition, when a response signal is recognized even by an electronic detonator disposed in a direction close to the blasting control system among adjacent directions, a response magnitude of the electronic detonator is generally inversely proportional to a distance to the blasting control system, so an increase in the response signal may be expected due to a propagation effect in which the electronic detonator close to the blasting control system participates in the response as recommunication attempts are repeated.

Figure 2:
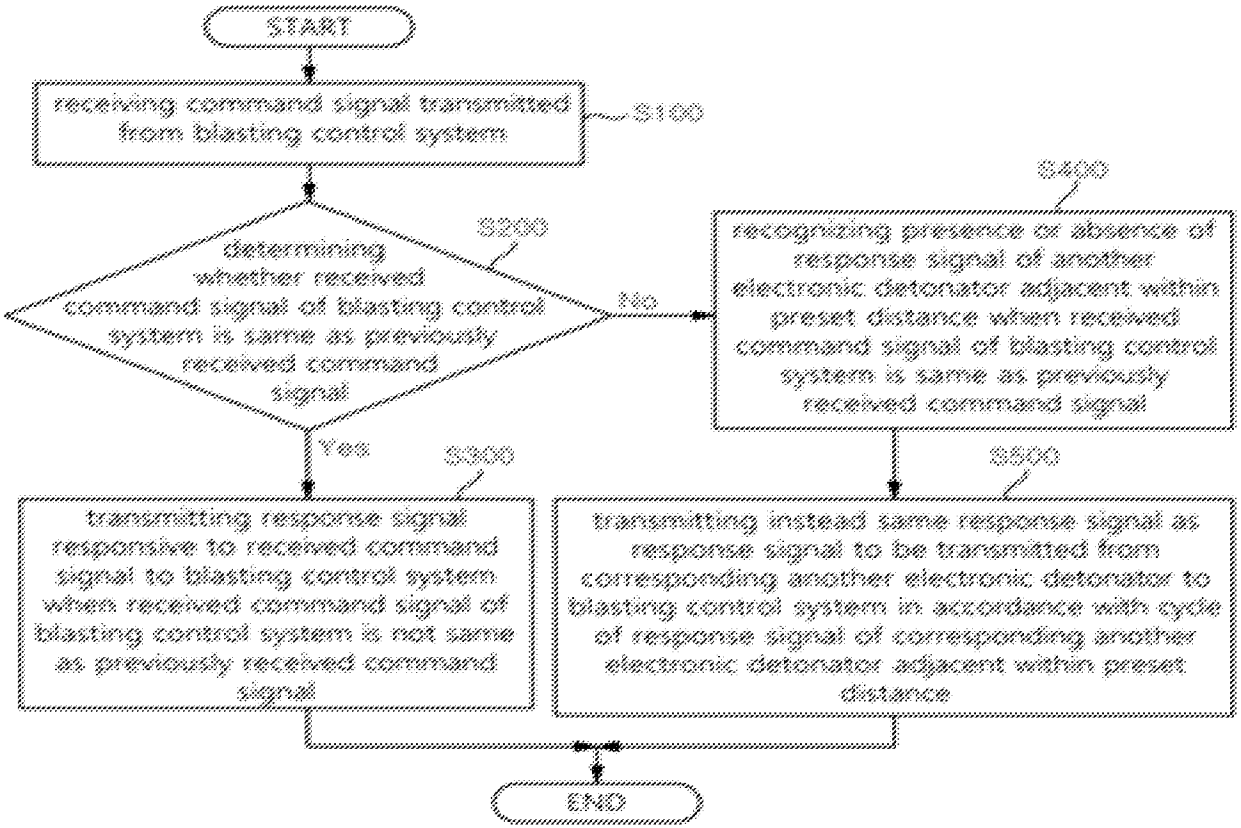
FIG. 2 is a flowchart illustrating a sequence of a method for operating an electronic detonator having a response relay function according to the present disclosure.

FIG. 2 is a flowchart illustrating a sequence of a method for operating an electronic detonator having a response relay function according to the present disclosure.

Describing with reference to FIG. 2, the method for operating the electronic detonator having the response relay function according to the present disclosure uses the device for operating the electronic detonator having the response relay function according to the present disclosure described above, and hereinafter, the duplicate description will be omitted.

First, in step S100, a command signal transmitted from a blasting control system is received.

Next, in step S200, it is determined whether the blasting control system's command signal received after step S100 is the same as a previously received command signal.

In step S300, a response signal responsive to the received command signal is transmitted to the blasting control system when the received command signal of the blasting control system is not the same as the previously received command signal in step S200.

Meanwhile, in step S400, presence or absence of a response signal of another electronic detonator adjacent within a preset distance is recognized when the received command signal of the blasting control system is the same as the previously received command signal in step S200.

Next, in step S500, the corresponding response signal is transmitted to the blasting control system when the response signal of another electronic detonator adjacent within the preset distance is recognized. In this case, the recognized response signal of another electronic detonator adjacent within the preset distance is the response signal that is not transmitted to the blasting control system.

In step S500, the same response signal as the response signal to be transmitted from another electronic detonator may be transmitted instead to the blasting control system in accordance with the cycle of the response signal of the corresponding another electronic detonator adjacent within the preset distance.

As described above, the functional operation and the embodiments related to the present subject matter, which are described in the present specification, may be implemented in a digital electronic circuit or computer software, firmware, hardware, or a combination of one or more thereof, including the structures and structural equivalents thereof, which are disclosed herein.

The embodiments of the subject matter described herein may be implemented as one or more computer program products, i.e., one or more modules related to computer program instructions encoded on a tangible program medium for execution by or for controlling the operation of a data processing device. The tangible program medium may be a radio wave signal or a computer-readable medium. The radio wave signal is a signal generated to encode information to be transmitted to an appropriate receiver device for execution by a computer, that is, for example, an artificially generated signal such as a machine-generated electrical, optical, or electromagnetic signal. The computer-readable medium may be a machine-readable storage device, a machine-readable storage substrate, a memory device, a combination of materials that affect a machine-readable radio wave signal, or a combination of one or more thereof.

Additionally, the logic flows and structural block diagrams described in the present patent document are intended to describe corresponding functions supported by the disclosed structural means and corresponding actions and/or specific methods supported by the disclosed steps, and may also be used to implement corresponding software structures and algorithms and their equivalents.

The present description presents the best mode of the present disclosure, and provides examples for describing the present disclosure and for enabling those skilled in the art to make and use the present disclosure. The specification written in this way is not intended to limit the present disclosure to the specific terms presented.

Accordingly, although the present disclosure has been described in detail with reference to the above-described examples, those skilled in the art can make modifications, changes, and deformation to the present examples without departing from the scope of the present disclosure. In short, in order to achieve the intended effect of the present disclosure, it is not necessary to separately include all the functional blocks shown in the drawings or follow all the orders shown in the drawings. It should be noted that even though all the functional blocks are separately included or all the orders shown in the drawings are followed as they are shown, the corresponding functional blocks and orders may fall within the technical scope of the present invention described in the claims.

The invention claimed is:

1. A device for operating an electronic detonator having a response relay function, the device comprising:

a command signal reception unit configured to receive a command signal transmitted from a blasting control system;

a response signal transmission unit configured to transmit a response signal of an electronic detonator responsive to the received command signal to the blasting control system;

a response signal delivery unit configured to transmit the corresponding response signal, which is the response signal of another electronic detonator, to the blasting control system when a response signal of another electronic detonator adjacent within a preset distance is recognized; and an adjacent response signal recognition unit configured to recognize presence or absence of the response signal of the corresponding another electronic detonator adjacent within the preset distance, wherein the adjacent response signal recognition unit recognizes presence or absence of the response signal of the corresponding another electronic detonator adjacent within the preset distance when the blasting control system's command signal received by the command signal reception unit is the same as a previously received command signal, and wherein the response signal delivery unit transmits instead the same response signal as the response signal to be transmitted from the corresponding another electronic detonator to the blasting control system in accordance with a cycle of the response signal of the corresponding another electronic detonator adjacent within the preset distance.

2. The device of claim 1, wherein the response signal of the corresponding another electronic detonator adjacent within the preset distance and recognized by the response signal delivery unit is a response signal that is not transmitted to the blasting control system.

3. A method for operating an electronic detonator having a response relay function, the method comprising:

receiving, by a command signal reception unit, a command signal transmitted from a blasting control system;

transmitting, by a response signal transmission unit, a response signal of an electronic detonator responsive to the received command signal to the blasting control system; and transmitting, by a response signal delivery unit, the corresponding response signal, which is the response signal of another electronic detonator, to the blasting control system when a response signal of another electronic detonator adjacent within a preset distance is recognized;

further comprising:

before the transmitting of the corresponding response signal to the blasting control system when the response signal of the corresponding another electronic detonator adjacent within the preset distance is recognized, recognizing presence or absence of the response signal of the corresponding another electronic detonator adjacent within the preset distance, wherein, in the recognizing presence or absence of the response signal of the corresponding another electronic detonator adjacent within the preset distance, the presence or absence of the response signal of the corresponding another electronic detonator adjacent within the preset distance is recognized when the blasting control system's command signal received by the command signal reception unit is the same as a previously received command signal, wherein, in the transmitting of the corresponding response signal to the blasting control system when the response signal of the corresponding another electronic detonator adjacent within the preset distance is recognized, the same response signal as the response signal to be transmitted from the corresponding another electronic detonator is transmitted instead to the blasting control system in accordance with a cycle of the response signal of the corresponding another electronic detonator adjacent within the preset distance.

4. The method of claim 3, wherein, in the transmitting of the corresponding response signal to the blasting control system when the response signal of the corresponding another electronic detonator adjacent within the preset distance is recognized, the recognized response signal of the corresponding another electronic detonator adjacent within the preset distance is a response signal that is not transmitted to the blasting control system.

* * * * *